United States Patent [19]

Danner et al.

[11] 4,223,909

[45] Sep. 23, 1980

[54] SKI WITH IMPROVED THREE-DIMENSIONAL RUNNING SURFACE

[75] Inventors: William D. Danner, Byfield, Mass.; Hans Woitschatzke, Grunwald, Fed. Rep. of Germany

[73] Assignee: Trak Incorporated, Ward Hill, Mass.

[21] Appl. No.: 16,121

[22] Filed: Mar. 1, 1979

[51] Int. Cl.[3] ..... A63C 7/06

[52] U.S. Cl. ..... 280/604

[58] Field of Search ..... 280/604, 609, 601, 11.37 G, 280/608; 9/310 R, 310 A, 310 D

[56] References Cited

U.S. PATENT DOCUMENTS

| | | | |
|---|---|---|---|
| 476,572 | 6/1892 | Stone | 280/604 |
| 3,408,086 | 10/1968 | Bennett | 280/604 |
| 3,858,894 | 1/1975 | Ver et al. | 280/604 |
| 4,118,050 | 10/1978 | Schnurrenberger | 280/604 |

FOREIGN PATENT DOCUMENTS

| | | | |
|---|---|---|---|
| 2623101 | 12/1977 | Fed. Rep. of Germany | 280/604 |
| 338246 | 3/1936 | Italy | 280/604 |

*Primary Examiner*—David M. Mitchell

*Attorney, Agent, or Firm*—Richard P. Crowley

[57] ABSTRACT

A ski with an improved, three-dimensional, running surface with a plurality of protuberances inclined with respect to the bottom plane of the running surface by rising towards the rear end of the ski, and the surface further characterized by a longitudinal pattern comprising: a gliding region beginning near the front end of the ski, wherein the protuberances terminate in convexly shaped, drop-off edges; a transition region, wherein the protuberances terminate in straight, drop-off edges, followed by a kick region roughly in the center of the ski's camber, wherein the protuberances terminate in concavely shaped, drop-off edges, followed by a second transition region; and a rear-glide region extending to near the rear end of the ski.

20 Claims, 6 Drawing Figures

SKI WITH IMPROVED THREE-DIMENSIONAL RUNNING SURFACE

BACKGROUND OF THE INVENTION

In cross-country or tour skiing, one aspect which is of considerable importance is the running surface of the ski, because such surface must be designed to reduce friction while gliding and yet provide sufficient control and stability with respect to kicking and climbing. Traditionally, tour-ski running surfaces, which engage the snow or ice, have had to be waxed carefully. A known alternative has been to modify structurally the running surface. Early attempts to modify such a surface were disclosed in U.S. Pat. No. 3,381,972. An improvement on this teaching was the utilization of a three-dimensional scale formation on the running surface, as exemplified in U.S. Pat. No. 3,408,086, hereby incorporated by reference. This patent discloses the employment of rows of protuberances with convexly curved edges along the running surface in a regular, repeating pattern over the gliding surface of the ski. Additionally, U.S. Pat. No. 3,858,894, hereby incorporated by reference, should be noted as an improvement on U.S. Pat. No. 3,408,086 in which protuberances, particularly trapezoidaltype formations, are nonharmonically spaced to eliminate or reduce the noise level during gliding movement of the ski.

While these variations of protuberances have been known for some time, they, alone, have not satisfied fully the combined requirements of skiers as to reducing friction while gliding, yet providing sufficient snow-gripping action during climbing and kicking maneuvers.

SUMMARY OF THE INVENTION

This invention relates to an improved, three-dimensional, ski base and to skis, particularly snow skis and more particularly cross-country skis, incorporating such an improved base. In particular, this invention envisions a cross-country or touring ski having a three-dimensional base or running surface, with a combination of scale-like and trapezoidal protuberances that have convex, straight and concave curves on their rearward edges, to provide a ski with significantly improved gliding and kicking properties.

The improved ski of this invention comprises a running surface having a plurality of differently shaped protuberances which vary longitudinally upon the surface from the ends of the ski to the center, so as to create, firstly, a specific, three-dimensional, surface configuration well-suited for gliding, secondly, another surface configuration that serves as a transition region, and, thirdly, at the center of the ski base, another surface configuration which optimizes kicking.

The gliding segment or region of the base comprises a plurality of transverse rows of scale-like protuberances, preferably some of which are longitudinally elongated near the ski ends, and all of which are characterized by having convex, rearward, drop-off edges.

The transitional region comprises a plurality of transverse rows of trapezoidal protuberances, preferably longitudinally shorter in comparison with the protuberances found in the glide region. The transition-region protuberances are characterized by straight-edge, rearward, drop-off edges.

The kick region also comprises a plurality of transverse rows of roughly trapezoidal protuberances. However, in this kick region, the protuberances are further defined, so as to have concavely shaped, rearward, drop-off edges.

During cross-country skiing, a skier's actions can be divided roughly into two parts: kicking and gliding. The kick occurs when the skier shifts his or her weight to one leg and pushes down and rearwardly. The most important glide occurs when a skier maintains nearly equal-weight distribution on each ski. Gliding properties in skis are often enhanced by adding a camber to the ski; that is, an arching or bowing up of the middle of the ski away from the snow; thus, distributing the skier's weight over a larger area of the running surface while gliding. To maximize the kick of the skier, it is necessary to increase the frictional forces on the running surface to the point where the force of the skier's leg propel the skier forward without backsliding; yet this must be done in a manner that does not appreciably increase the friction during the skier's gliding action.

It has been discovered that the efficiency of a skier's kick and glide can be improved by varying the shape of a series of three-dimensional protuberances or scales along the running surface of a ski, as disclosed herein, and that this invention is particularly well-suited for use with cambered skis.

The particular arrangement of gliding, transitional and kicking sections along the longitudinal axis of the ski base provides for unexpected improvement over any one of the particular structural features, alone. In addition, it has been found that varying the height of the drop-off edges provides an even better combination of ski properties. Thus, for example, the height of the rear, drop-off edge may vary from 0 to 1.0 mm or more, but preferably from 0.1 to 0.8 mm, with the kicking section having edges of the greatest height (for example, kicking —0.5 to 1.0 mm; transition—0.3 to 0.5 mm; and gliding—0.1 to 0.3 mm). Furthermore, it has been discovered that varying the size of the protuberances also provides a better combination of ski properties. For example, the gliding and kicking properties may be enhanced by using a larger number of small scales in the kick section and a lesser number of large scales in the glide section. The particular length of each section along the longitudinal axis of the ski may vary with the running surface, itself, but typically the kicking section extends directly under the length or slightly more of the ball of the skier's foot, while the transition region is short; for example, 2.0 to 10 cm in length, and while the gliding section extends, as desired, toward the tip and rear end of the ski.

The three-dimensional base is typically made from a polymer material, such as a thermoplastic like polyethylene or other plastic material, formed by an extrusion or molding operation. The plastic base is then secured to the ski to form the ski bottom or running surface. Alternatively, the polymer running surface may be formed as an integral part of the ski during manufacture, instead of being secured adhesively to the ski after manufacture.

This invention will be described in connection with the illustrated embodiments below; however, it should be recognized that various changes and modifications may be made by those persons skilled in the art, without departing from the intent and scope of this invention.

DESCRIPTION OF THE EMBODIMENTS

Figure 1:
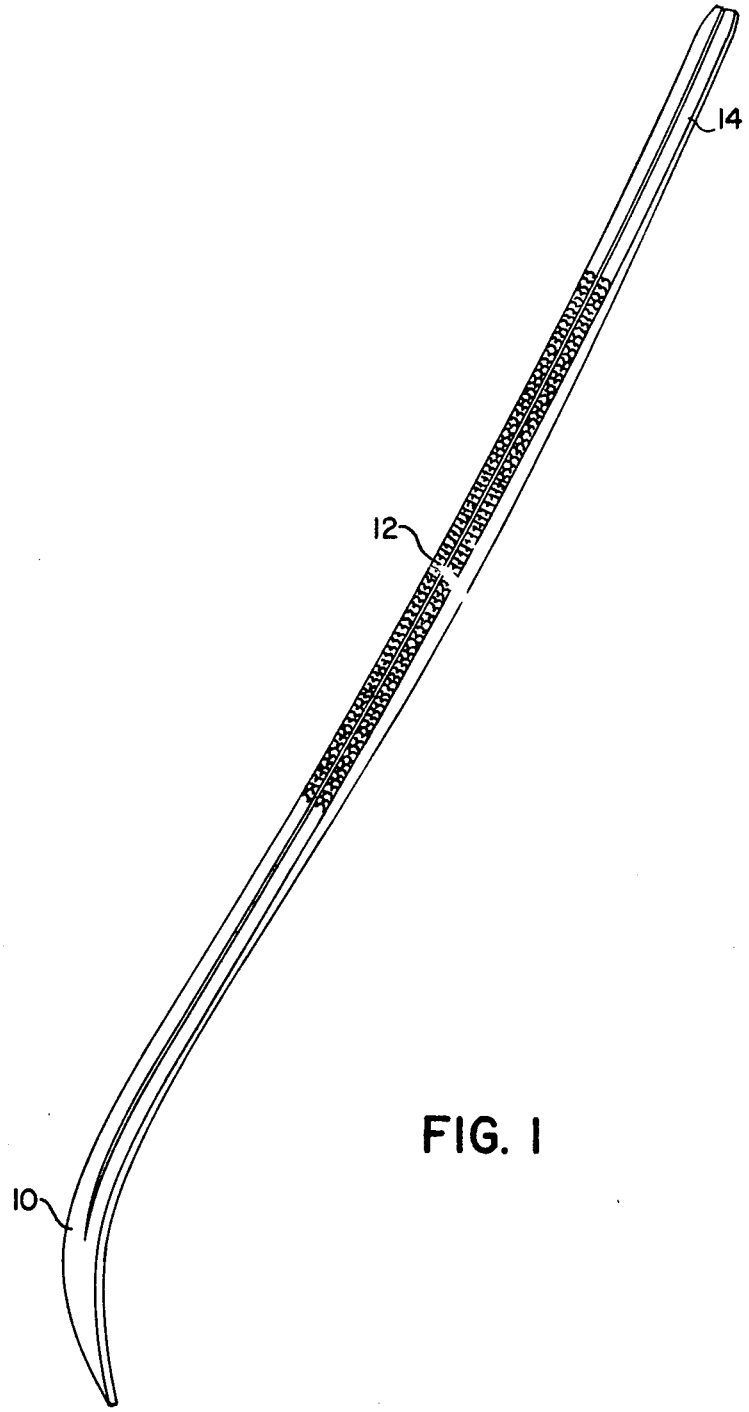
FIG. 1 is a perspective view of a single ski with the present invention embodied upon its base or bottom.
Figure 2:
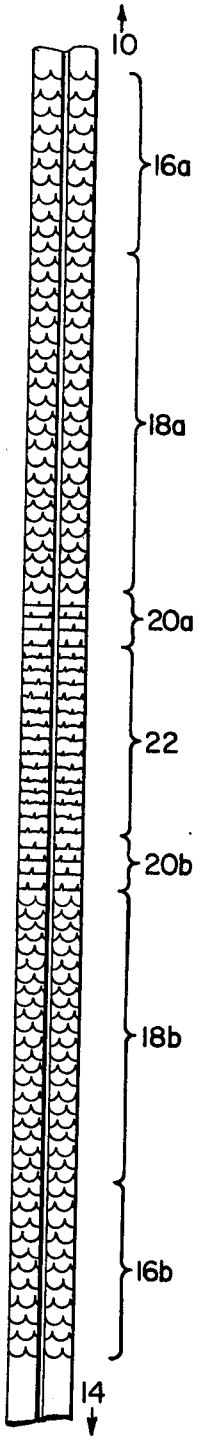
FIG. 2 is a bottom plan view of the section of the ski embodying the present invention.

FIGS. 1 and 2 show the shifting pattern of scales as described herein. In this embodiment, a gliding region of scales begins a short distance from the ski tip 10 as elongated protuberances 16*a* having exposed faces inclined relative to the general plane of the bottom and terminating in a rearward direction in a convexly curved, drop-off edge, basically following the teaching of U.S. Pat. No. 3,408,086. Proceeding longitudinally along the running surface towards the middle of the ski 12, a region of shortened, gliding scales 18*a*, still terminating in a rearward direction in a convexly curved, drop-off edge, is encountered.

Continuing longitudinally, a region of trapezoidal scales 20*a*, having roughly straight, rearward, drop-off edges, is encountered, which is the transtion region. Following the transition region of straight-edged scales, a kicking region of concave scales 22 is encountered, such region being located approximately directly below the skier's foot. The pattern reverses itself after procession from the tip to the kick regions. Continuing longitudinally away from the middle region and towards the rear end 14 of the ski, another straight-edged, transition region 20*b*, then a shortened, convexly shaped, glide region 18*b* and finally an elongated, convexly shaped, glide region 16*b* are encountered.

Figure 3:
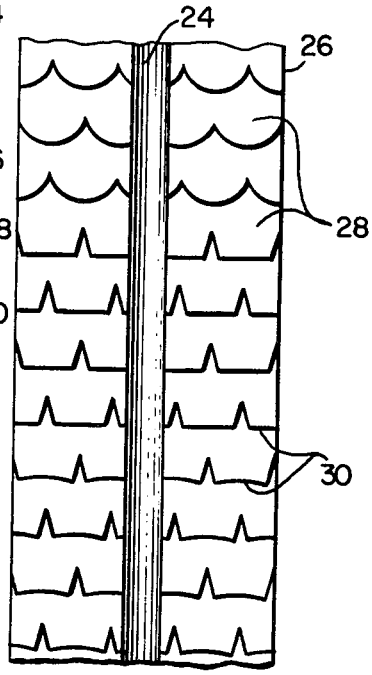
FIG. 3 is an enlarged view of a segment of FIG. 2, showing the glide, transition and kick regions on the bottom surface.

FIG. 3 is a drawing of a segment from the foreward portion of the ski running surface, showing the gliding, transition and kicking regions more clearly. The ski base is divided by a groove 24 running longitudinally along the center of the ski. Protuberances 28 lie on both sides of the groove 24 and extend to the edge 26 of the ski. In this embodiment, the protuberances are set out in rows running perpendicular to the groove 24, and the protuberances of each row are misaligned with respect to the next row.

Figure 5:
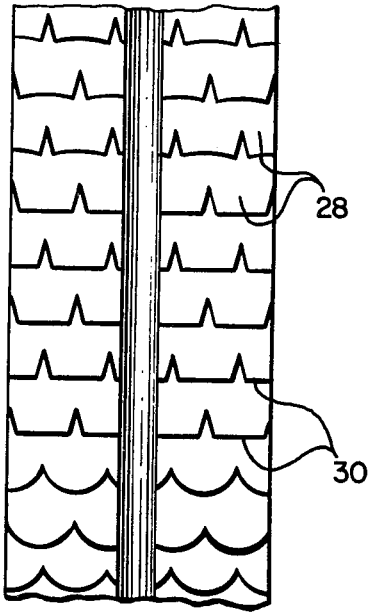
FIG. 5 is an enlarged view of another segment of FIG. 2.

FIG. 5 is a drawing of a segment from the rearward portion of the ski base, showing how the pattern of protuberances reverses itself as it progresses from the center of the ski to the rear end.

Figure 4:
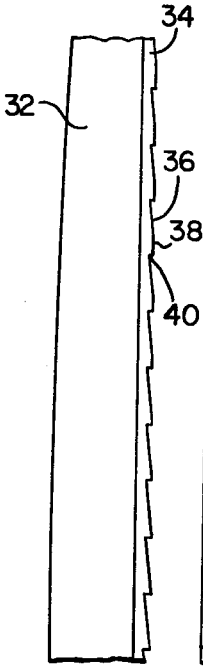
FIG. 4 is a longitudinal, sectional view of FIG. 3.
Figure 6:
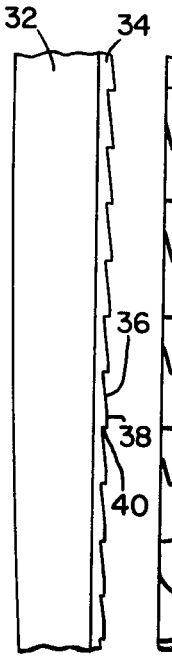
FIG. 6 is a longitudinal, sectional view of FIG. 5.

FIGS. 4 and 6 show longitudinal, sectional views of the ski segment illustrated in FIGS. 3 and 5, respectively. It is pointed out that both FIGS. 4 and 6 are exaggerated, in order to show more clearly the construction and the action involved in this invention. As shown, the ski body 32 is connected to a base 34 having the protuberances incorporated thereon. The protuberances are each inclined with respect to the bottom plane of the base 34, by rising towards the rear end of the ski before dropping off. In this embodiment, three distinct aspects of each protuberance can be seen: firstly, a steadily inclining surface 36 beginning at the forward edge of each protuberance; secondly, a flattened surface or plateau 38 near the rearward end of the protuberance; and, thirdly, a drop-off edge 40. The variation in height of the dropoff edges, between the gliding and kicking regions, is clearly shown by the exaggerated form of FIGS. 4 and 6.

Preferably the kicking region of concavely shaped scales is about 10 to 20 cm in length. In operation, it is over this region, roughly 10 to 20 cm, that most of the skier's kicking force is transmitted. As a skier kicks, the skier shifts his or her weight to the ball of one foot and pushes down and rearwardly. An increasing force is applied by the skier, the camber of the ski is overcome and the bearing-force distribution along the running surface changes, so that most of the force is transmitted to the snow or ice by the region of the running surface directly below the skier's boot. In order for the skier to propel forward, it is necessary for the skier to exert a sufficient force normal to the snow or ice, so that resulting frictional forces prevent rearward slippage. If the skier is travelling up an incline as he or she attempts to kick, it is even more difficult to maintain sufficient frictional force or grip on the snow or ice surface to continue upward, as the skier can no longer rely on the full-force gravity transmitting his or her weight normally to the snow or ice surface.

The present invention discloses a means of increasing frictional forces acting contrary to slippage in the region of the ball of a skier's foot during the kick. The means are the concavely shaped scales shown in detail in FIGS. 3 and 4. By the utilization of concavely shaped, drop-off edges in this region, the rearward perimeter or edge of each scale is increased, and thus the contact area available to resist slippage is also increased. The use of such concavely shaped scales, solely in the region of the skier's foot, has the advantage of providing additional frictional forces only where needed (where most of the skier's force is transmitted via the running surface of the snow of ice). Use of shortened scales in this kick region is also beneficial, as it allows a greater number of concavely shaped, drop-off edges to be placed in the region; thus, further increasing the resistance to slippage.

It has been found that use of such concavely shaped scales, shortened or not, along the entire running surface, is not recommended, as the concave configuration does increase the coefficient of friction in both the forward and rearward directions, and such a uniform, concave, scale configuration would, therefore, interfere unnecessarily with the skier's gliding action. Additionally, it has been discovered that interference with gliding by the concavely shaped scales can be decreased by the use of transitional regions, such as the straight-edged scales and the shortened, convexly shaped scales described in the preferred embodiment.

As mentioned previously, the height of the drop-off edges may vary, so that the highest edges are found in the middle (longitudinally) of the ski. Such a variation in height compliments the invention disclosed herein by helping also to provide a greater frictional force acting against slippage in the kick region.

It should be noted that the embodiment disclosed herein includes a number of features that are not essential to the practice of the invention, itself. For example, a center groove, running longitudinally in the ski base, is not essential to the invention, nor is the misalignment of certain rows of the protuberances. Furthermore, while the preferred embodiment reveals protuberances having specific shapes, either scale-like or trapezoidal, with inclined surfaces, plateaus and rear drop-off edges, it should be obvious that other structures may be substituted. For example, a scale-like or trapezoidal protuberance could be constructed without a plateau, having, instead, only an inclined surface and rear drop-off edges. Similarly, a dome-shaped structure with a drop-off edge could be substituted for the incline and plateau.

What we claim is:

1. A ski for use by a skier on snow or ice surfaces, said ski having a front end and a rear end and a three-dimensional, bottom, running surface, which surface comprises a plurality of protuberances which are inclined with respect to the bottom plane of said running surface by rising towards said rear end of said ski before dropping off, and which running surface is further characterized by a longitudinal pattern in the shape of said protuberances, said ski comprising:

(a) a kick region, wherein said protuberances terminate in concavely shaped, rear, drop-off edges, said region being located substantially beneath the skier's foot along said running surface, where a substantial portion of the skier's locomotive force is transmitted to said snow or ice surface;

(b) transition regions generally proximate to, and on both sides of, the kick region, extending forward and rearward from the kick region, and wherein said protuberances terminate in substantially straight, rear, drop-off edges; and (c) glide regions generally proximate to the transition regions and extending from the transition regions toward the ends of the ski, wherein said protuberances terminate in convexly shaped, rear, drop-off edges, said gliding regions being located along said running surface, so as to bear a portion of the skier's weight while gliding, thereby providing a ski with enhanced gliding and kicking properties.

2. The ski of claim 1 which is further characterized by a longitudinal pattern in the shape of said protuberances, said ski comprising:

(a) a front gliding region beginning near the front end of the ski, wherein said protuberances terminate in convexly shaped, rear, drop-off edges;

(b) a front transitional region immediately following said front gliding region, wherein said protuberances terminate in straight, rear, drop-off edges;

(c) a kicking region immediately following said front gliding region, wherein said protuberances terminate in concavely shaped, rear, drop-off edges;

(d) a rear transitional region immediately following said kicking region, wherein said protuberances terminate in straight, rear, drop-off edges; and (e) a rear gliding region ending near the rear end of said ski, wherein said protuberances terminate in convexly shaped, rear, drop-off edges.

3. The ski of claim 1 wherein the pattern of said protuberances on said running surface is further characterized by an elongation of said protuberances in the longitudinal direction near the front and rear ends of said ski, changing to shortened protuberances in the center of said ski.

4. The ski of claim 1, wherein the pattern of said protuberances of said running surface is further characterized by a variation in the height of said rear, drop-off edges, such that the highest drop-off edges are located in the center of said ski and the lowest drop-off edges are located at said front and rear ends.

5. The ski of claim 1 wherein a groove is carried in said ski bottom, running longitudinally along the center of said bottom surface, and wherein said protuberances are located on both sides of said groove between said groove and the ski edge.

6. The ski of claim 1 wherein said kicking region is located directly below the ball of said skier's foot.

7. The ski of claim 1 wherein a camber is incorporated into said ski, thereby causing said ski bottom to arch up away from said snow or ice at the center of said camber, and wherein the kicking region is located at the center of said camber.

8. The ski of claim 1 wherein the size of the protuberances is varied to provide a larger number of small protuberances in the kick region and a lesser number of large protuberances in the glide region.

9. The ski of claim 1 wherein the length of the kick region is approximately 10 to 20 cm.

10. The ski of claim 1 wherein the lengths of the transition regions are each approximately 2 to 10 cm.

11. The ski of claim 1 wherein the height of the drop-off edges varies from 0.1 0.8 mm.

12. The ski of claim 1 wherein the height of the drop-off edges in the kick region ranges from 0.5 to 1.0 mm, the height of the drop-off edges in the transition regions ranges from 0.3 to 0.5 mm, and the height of the drop-off edges in the glide region ranges from 0.1 to 0.3 mm.

13. The ski of claim 1 wherein said protuberances are aligned transversely in rows.

14. The ski of claim 13 wherein each transversely aligned row is longitudinally misaligned with respect to the immediately preceding and following rows.

15. A cambered ski for use by a skier on snow or ice and constructed so as to arch away from the snow or ice at its center, said ski comprising:

a front end, a rear end and a three-dimensional, bottom, running surface, said running surface carrying a groove longitudinally in its center and comprising a plurality of rows of protuberances on both sides of said groove, each of said rows being longitudinally misaligned with respect to the immediately preceding and following rows of protuberances, said protuberances being inclined with respect to the bottom plane of said running surface by rising towards said rear end of said ski before dropping off, and which running surface is further characterized by a longitudinal pattern in the shape of said protuberances, said ski comprising:

(a) a front gliding region beginning near the front end of the ski, wherein said protuberances terminate in convexly shaped, rear, drop-off edges, and wherein the protuberances nearest to said front end are elongated longitudinally and have shallow, rear, drop-off edges;

(b) a front transitional region immediately following said front gliding region, wherein said protuberances terminate in straight, rear, drop-off edges, are shortened longitudinally and have deeper, rear, drop-off edges;

(c) a kicking region immediately following said front transition region, wherein said protuberances terminate in concavely shaped, rear, drop-off edges, are also shortened longitudinally, and have drop-off edges that are deeper than those found in either the gliding or transitional region, said kicking region being further defined as being located directly above said camber of said ski, and wherein the skier's locomotive forces are transmitted via the running surface to the snow or ice;

(d) a rear transitional region immediately following said kicking region, wherein said protuberances are substantially similar to the protuberances of the front transitional region; and (e) a rear gliding region immediately following said rear transitional region, wherein the protuberances are substantially similar to the protuberances of the front gliding region, and wherein the protuberances nearest to said rear end are elongated longitudinally and have shallow, rear, drop-off edges.

16. A plastic, base material adapted to be secured to or employed as the running surface of a ski, which base material comprises a thermoplastic material having, on its surface, a plurality of protuberances which are inclined with respect to the bottom plate of said running surface by rising towards the rear end of said ski before dropping off, said protuberances being further characterized by a longitudinal pattern in the shape of said protuberances, said base material comprising:

(a) a front gliding region beginning near the front end of the ski, wherein said protuberances terminate in convexly shaped, rear, drop-off edges;

(b) a front transitional region immediately following said front gliding region, wherein said protuberances terminate in straight, rear, drop-off edges;

(c) a kicking region immediately following said front gliding region, wherein said protuberances terminate in concavely shaped, rear, drop-off edges;

(d) a rear transitional region immediately following said kicking region, wherein said protuberances terminate in straight, rear, drop-off edges; and (e) a rear gliding region ending near the rear end of said ski, and wherein said protuberances terminate in convexly shaped, rear, drop-off edges.

17. The base material of claim 16 wherein the material comprises polyethylene

18. The base material of claim 16 wherein the material comprises a transparent thermoplastic.

19. The base material of claim 16 wherein the length of the kick region is approximately 10 to 20 cm, and the height of the drop-off edges in the kick region ranges from 0.5 to 1.0 mm.

20. The base material of claim 16 wherein the lengths of the transition regions are each approximately 2 to 10 cm and the height of the drop-off edges in the transition regions ranges from 0.3 to 0.5 mm.

* * * * *